United States Patent [19]

Matsuda et al.

[11] Patent Number: 4,785,217

[45] Date of Patent: Nov. 15, 1988

[54] CATHODE RAY TUBE WITH ANTISTATIC FILM ON FRONT PANEL

[75] Inventors: Hidemi Matsuda, Oomiya; Takeo Itou, Fukaya, both of Japan

[73] Assignee: Kabushiki Kaisha Toshiba, Kawasaki, Japan

[21] Appl. No.: 136,944

[22] Filed: Dec. 23, 1987

[30] Foreign Application Priority Data

Dec. 24, 1986 [JP] Japan ..... 61-306512

[51] Int. Cl.[4] ..... H01J 29/86

[52] U.S. Cl. ..... 313/479; 313/313

[58] Field of Search ..... 313/479, 477 R, 313, 313/85, 478

[56] References Cited

U.S. PATENT DOCUMENTS 4,563,612 1/1986 Deal et al. ..... 313/479 X

FOREIGN PATENT DOCUMENTS 4775 1/1977 Japan ..... 313/479
94337 5/1984 Japan ..... 313/479
96638 6/1984 Japan ..... 313/479
61-16452 1/1986 Japan .
61-118932 6/1986 Japan .

*Primary Examiner*—Palmer C. DeMeo
*Attorney, Agent, or Firm*—Cushman, Darby & Cushman

[57] ABSTRACT

This invention provides a cathode-ray tube having an antistatic film formed mainly by metal oxide and containing particles of at least one metal selected from the group consisting of Pd, Sn, Pt, Ag and Au, the particles having an average particle size of 0.01 micron at most. The film can be easily formed from a solution, thus, reducing the cost.

3 Claims, 4 Drawing Sheets

CATHODE RAY TUBE WITH ANTISTATIC FILM ON FRONT PANEL

BACKGROUND OF THE INVENTION

1. Field of the Invention

The present invention relates to a cathode-ray tube, having an antistatic film on the outer surface of a front panel, and a method for manufacturing the same.

2. Description of the Prior Art

An electrostatic charge is accumulated on the outer surface of the front panel of a cathode-ray tube during or after the operation of the tube. Thus, dust is attracted to the outer surface of the cathode-ray tube, and an operator may suffer from an electric shock, if he or she touches the outer surface of the cathode-ray tube.

Japanese Patent Disclosures (Kokai) No. 61-118932 and (Kokai) No. 61-118946 disclose a cathode-ray tube having an uneven surface made of $SiO_2$ having a silanol group and formed on the outer surface of the front panel, Japanese Patent Disclosure (Kokai) No. 61-16452 discloses a cathode-ray tube having a film mainly composed of silicate material and an inorganic metallic compound and formed on the outer surface of the front panel.

The silanol group method for preventing charging utilizes the phenomenon that the silanol group adsorbs moisture in the air, thereby reducing the outer surface resistance with the moisture. Since this method utilizes the moisture in the air, the degree of effectiveness in preventing the charge depends upon the amount of moisture in the air. Thus, in a dry season or a district of low humidity, this method will not work effectively.

The method for preventing charging, wherein the film made of the silicate material and the inorganic metallic compound is used, cannot reduce the electric resistance of the film when an inorganic metallic compound such as $SiO_2$ having a certain degree conductivity, does not exist in the film. If the compound having conductivity, such as $SiO_2$, exists in a sufficient amount for reducing the electric resistance of the film, the strength of the antistatic film decreases, and the film cannot be used in practice.

Such a conventional cathode-ray tube involves a large deviation in the electric resistance value, or insufficiency in the strength of the antistatic film.

SUMMARY OF THE INVENTION

An object of the present invention is to provide a cathode-ray tube which has an enhanced antistatic effect.

Another object of the present invention is to provide a method for manufacturing a cathode-ray tube which has an enhanced antistatic film formed on the outer surface of the front panel.

According to the present invention, there is provided a cathode-ray tube comprising a front panel, and an antistatic film which is formed on the outer surface of the front panel which contains metal oxide and metallic particles of at least one element selected from the group consisting of Pd, Sn, Pt, Ag and Au, having an average particle size of at most 0.01 micron.

The preferred metal oxide is silicon oxide.

The preferable content of metal particles in the antistatic film is within a range of 0.01 to 5.0 wt. %. The antistatic film of the cathode-ray tube of the present invention is provided by introducing conductive particles such as metal or carbon into an insulative film, thereby imparting conductivity. However, the particle size is at least 0.1 micron, thus a large quantity of conductive particles must be contained in the film in order to provide conductivity to an insulating material. As a result, the antistatic film is no longer transparent due to the existence of so many particles, or the quality of the materials are changed so as to lose the antistatic property of the film formed on the outer surface of the front panel of the cathode-ray tube.

The inventors hereof have found that even a small amount of metal particles can impart sufficient conductivity to the antistatic film if the particles are small enough. More specifically, FIG. 1 shows the surface resistance of the film when introducing 0.1 wt. % of Pd particles into an $SiO_2$ film formed from alcoholate of silicon. The film is formed by a spraying method, and heated at 460° C. for 30 min. As understood from FIG. 1, when the average particle size of the Pd particles is at most 0.01 micron, the surface resistance of the film is reduced. On the other hand, the film is not sufficiently antistatic unless it has a surface resistance of at most $5\times10^9$ ohms. Therefore, it is desirable to use particles whose average particle size is at most 0.01 micron. More preferably, in order to obtain a resistance value of $10^7$ order, the average particle size of the metal should be 0.007 micron at most. In this case, the smaller the metal particles, the lower the resistance value. Thus, the smaller the particles, the better. When the metallic particles are made of Pd, the preferable particle size is 1.34 angstrom. In the actual manufacture, there is a possibility that such particles are contained in the film.

The average particle size of 0.001 micron is empirically confirmed in the present invention. FIG. 2 shows the relationship between the content of the metal particles and the surface resistance of the film. The conditions for forming the film are the same as those shown in FIG. 1, and the average particle size of the metallic particles is 0.005 micron. As shown in FIG. 2, when the content of metallic particles in the film is as large as 0.01 wt. %, the film exhibits sufficient conductivity. If the content exceeds 5.0 wt. %, the strength of the film drops. Therefore, the content of the metallic particles in the film should preferably fall within a range of 0.01 to 5.0 wt. %, and more preferably, 0.05 to 0.5 wt. %.

According to the present invention, there is provided a method for manufacturing a cathode-ray tube comprising the steps of: adding a substance for reducing the metallic compound to a film-forming material solution, containing a compound of at least one metal selected from the group consisting of Pd, Sn, Pt, Ag and Au; producing a colloidal solution or a solution by dispersing fine metal particles having an average particle size of at most 0.01micron in the film forming material solution; and coating the outer surface of the front panel with the colloidal solution or the solution, drying the solution to form an antistatic film. This method can further comprise a step of drying and heating the solution in order to form the antistatic film.

Further, according to the present invention, there is also provided a method for manufacturing a cathode ray tube comprising the steps of: forming a coating layer contained with a substance for reducing a compound of at least one metal, selected from the group consisting of Pd, Sn, Pt, Ag and Au, on the outer surface of the front panel; coating the coating layer with a film-forming material solution containing a compound of at least one metal selected from the group consisting of Pd, Sn, Pt, Ag and Au; liberating fine metal particles, having an average particle size of at most 0.01 micron, in the film-forming material solution by reducing the metallic compound; and drying the coating layer to form a charge preventive film. This method can further comprise a step of drying and heating the coating layer to form the antistatic film.

The method for forming the antistatic film, according to the present invention, will be described. The metallic oxide, i.e., the main component of the antistatic film, is obtained, for example, by condensing the alcoholate of metal. When the metal is silicon, the metallic oxide is obtained by burning water glass. When metallic oxide is produced from this liquid, at least one metal, selected from the group consisting of Pd, Sn, Pt, Ag and Au, is dissolved in the film-forming material solution.

When the compound for reducing the metals is added to the film-forming material solution under suitable conditions, a solution (e.g. A) or a colloidal solution (e.g. B), both containing metal particles, can be produced. The suitable conditions include the addition of a surfactant, etc. More specifically, when a cation surfactant or a nonionic surfactant is added to a film forming solution, a metallic colloidal solution containing relatively small particles and having an excellent stability is produced. When an anion surfactant is added, a metallic colloidal solution containing relatively large particles and having a slightly lower stability is produced. However, in either case, the average particle size is 0.01 mm at most, and the metallic colloidal solution has sufficient stability. The film-forming material solution obtained by the method described above will be called hereinafter either "colloidal solution" or "solution". The colloidal solution is generally called "fine particle dispersion, ranging from 1 nm to 1 micron, and a solution containing particles having a particle size not more than 1 nm, is generally called "solution".

The metallic particles used in the present invention provide the same effect, provided that their size is 0.01 micron at most, such as one atom size (0.137 nm in the case of Pd) or 0.01 micron. This is why, the solution used in this invention is called "colloidal solution" or "solution". The film-forming material solution produced as described above is coated by a dispensing method, a spraying method or a dipping method, on the outer surface of the front panel of the cathode ray tube, and is dried to form an antistatic film on the cathode-ray tube. The film may be dried and heated to form the film it required.

The antistatic film may be formed by the following method. The antistatic film is formed by coating the outer surface of the front panel of the cathode-ray tube with a substance for reducing a compound of at least one metal selected from the group consisting of Pd, Sn, Pt, Ag and Au, coating the coating layer with a film-forming material solution containing a compound of at least one metal selected from the group consisting of Pd, Sn, Pt, Ag and Au, thereby reducing the metal compound with the substance and liberating fine metal particles, having an average particle size of at most 0.01 micron, in the solution, and drying the solution. These two methods are simpler than the method of introducing metal particles into the solution or film, and can distribute the fine metal particles more easily and uniformly. Further, the film-forming material solutions obtained by these two methods are much more stable than the solution prepared by introducing metal particles into a solvent or a film.

DETAILED DESCRIPTION OF THE PREFERRED EMBODIMENTS

The examples of the present invention will now be described.

EXAMPLE 1

Figure 1:
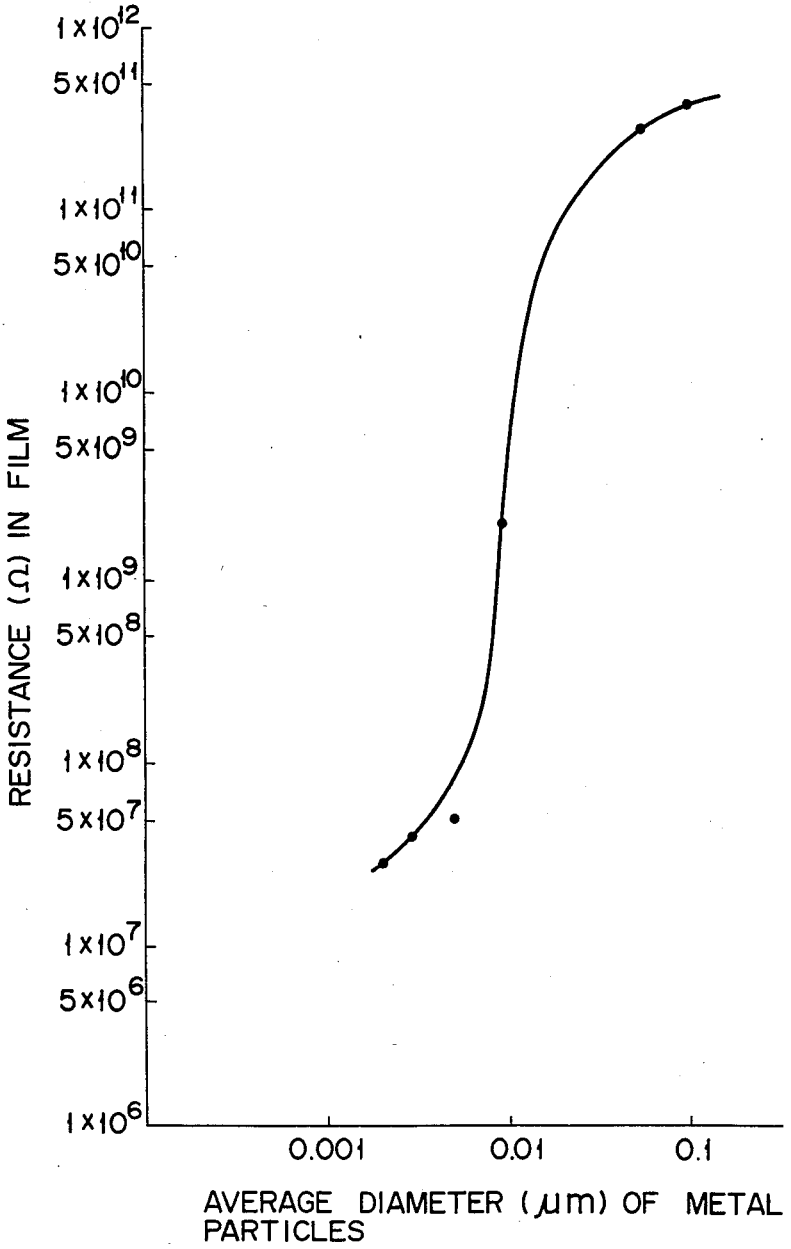
FIG. 1 is a characteristic diagram showing the relationship between the average size of the metallic particles contained in a film and the surface resistance value of the film.
Figure 2:
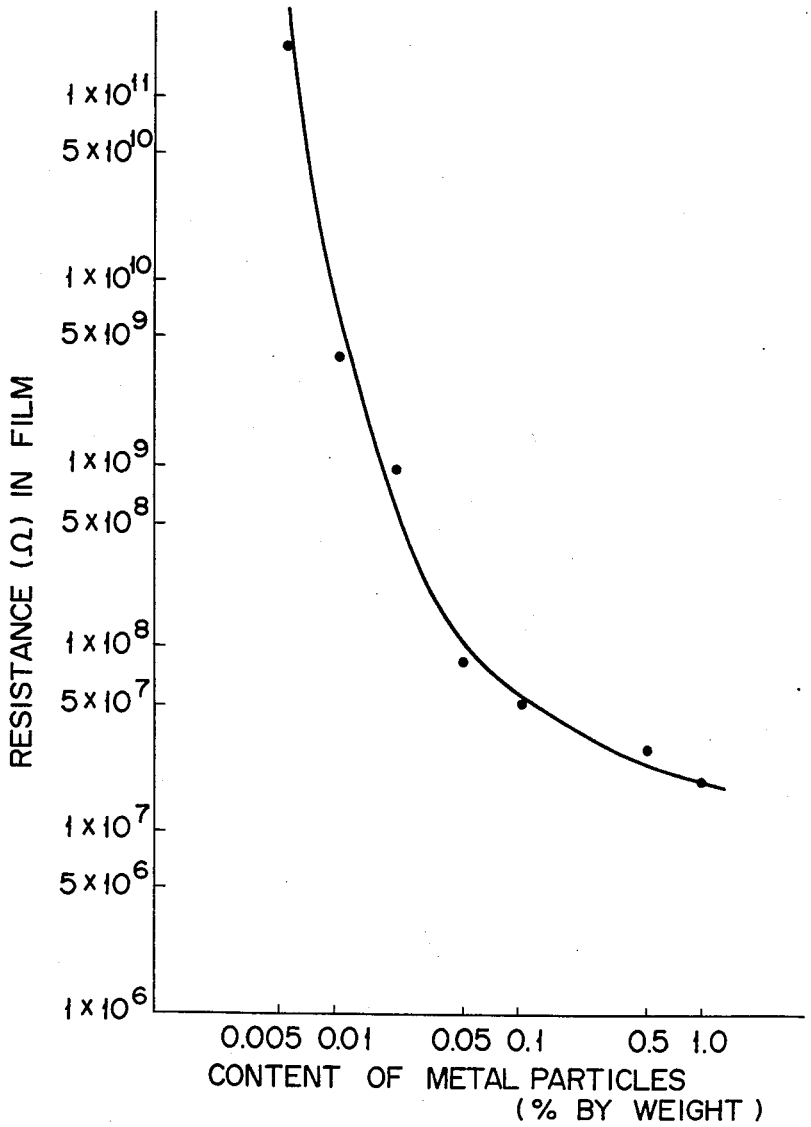
FIG. 2 is a characteristic diagram showing the relationship between the content of the metallic particles in the film and the surface resistance of the film.
Figure 3:
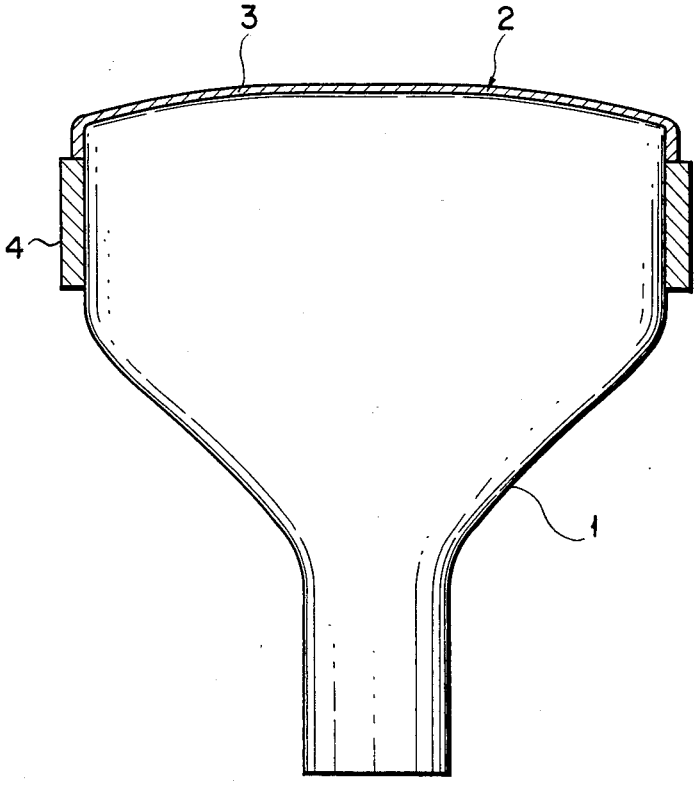
FIG. 3 is an explanatory view of a 21 inch color picture tube for use in a first embodiment of the present invention.

The front panel 2 of a 21-inch color picture tube 1 shown in FIG. 3 was cleaned free of dust, oil contents, etc. Then, a film-forming material solution was coated on the outer surface of the front panel 2 by dipping panel 2 in the solution. The coated solution was dried, thus forming antistatic film 3. Reference numeral 4 in FIG. 3 denotes an explosion-proof band.

The film forming material solution was prepared by the following method:

$PdCl_2$ was dissolved in water, a nonionic surfactant was added to the solution, and a reducing reagent was added thereto, thereby preparing the Pd colloidal solution. The colloidal solution was then dropped into a mixture solution of $Si(OC_2H_5)_4$, $(CH_3)_2CHOH$, $C_4H_9OH$ and a small amount of acid, thus producing a film-forming material solution. Any reducing reagent that can reduce Pd of $PdCl_2$, such as $SuCl_2$, $NaBH_4$, $LiAlH_4$, etc, can be used in this example.

EXAMPLE

The front panel of a 21-inch color picture tube was cleaned in the same way as in Example 1, thus removing dust, oil contents, etc. Then, diluted HCl solution, dissolved with $SuCl_2$ for reducing Pd of $PdCl_2$, was coated on the outer surface of the front panel and dried. Then, $PdCl_2$ was dissolved in a solution prepared by dissolving $PdCl_2$ in solution prepared by mixing $Si(OC_2H_5)_4$, $(CH_3)_2CHOH$, $C_4H_9OH$ and a small amount of acid. The resultant solution was then coated on the front panel and dried, thereby producing the antistatic film.

The amount of $PdCl_2$ used in the Examples 1 and 2 was 0.1 wt. % based on the film thus formed. The antistatic film formed on the front panel in these Examples 1 and 2 was heated at 200° C. for 15 min. and strenghened. The strength of the film was proven by the fact that the film exfoliated when 1 kg/cm$^2$ of pressure was applied to it by a sand eraser rubbing the film 50 times. About one of half portion of the film coated with the dried solution exfoliated when rubbed with the sand easer, but, the dried and heated film did not exfoliated under the same conditions.

Figure 4:
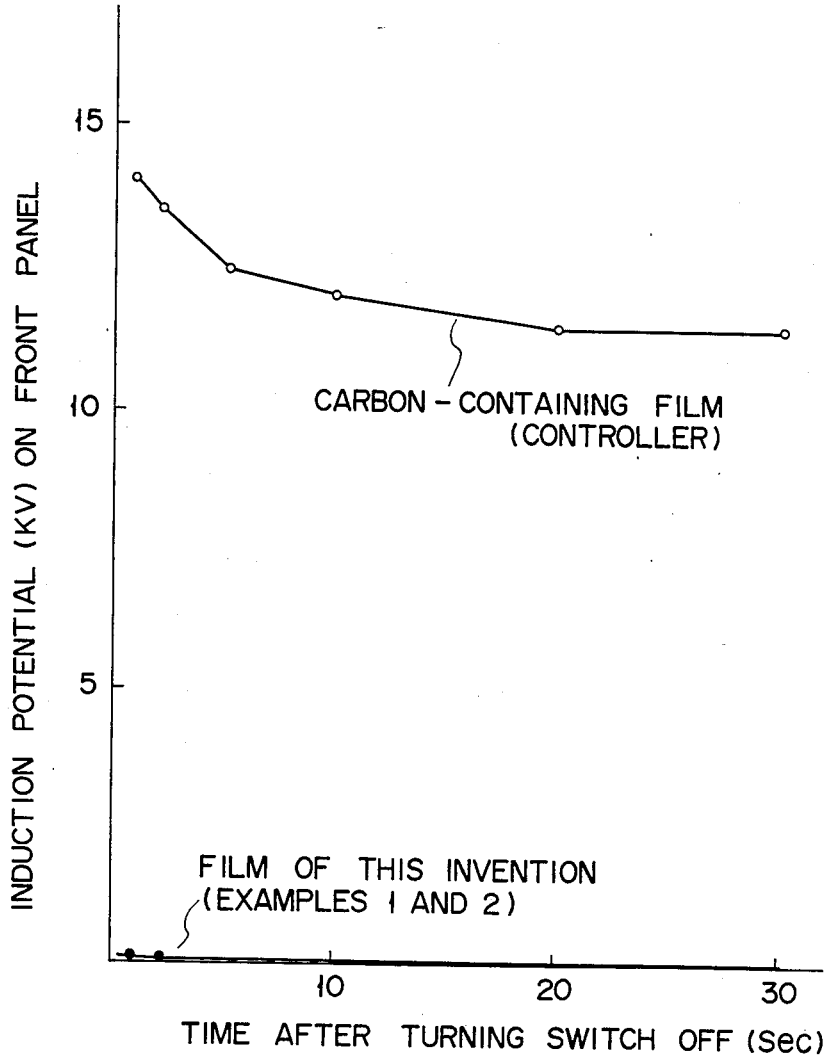
FIG. 4 is a characteristic diagram showing the antistatic characteristic of the cathode-ray tube obtained in example 3 of the present invention.

FIG. 4 shows how the potential induced in the 21-inch color picture tubes of Examples 1 and 2 changes after these tubes have been turned off, and how the potential induced in the 21-inch color picture tube of a controller changes after the tube has been turned off. The tube of the controller was made by adding particles having an average particle size of 0.042 micron to the film-forming material solution, in an amount of 0.01 wt. %, coating the solution on the front panel and drying the solution, thus forming a film, and burning the film at 200° C. for 15 min. As is apparent from FIG. 4, in the embodiment of the present invention, the inductive potential decreased to "0" in several seconds after the tube had been turned off, whereas the inductive potential of the controller tube did not decrease less than 10 kV after a long time had elapsed.

The antistatic film of the cathode-ray tube according to the present invention is, of course, connected to an electric path which is, in turn, coupled to a ground potential. The film can be connected to the electric path by any means, such as an explosion-proof band or another electric path.

What is claimed is:

1. A cathode-ray tube comprising:

a front panel, and an antistatic film formed on the outer surface of the front panel, made of mainly metal oxide and containing particles of at least one metal selected from the group consisting of Pd, Sn, Pt, Ag, and Au, said particles having an average particle size of 0.01 micron at most.

2. A cathode-ray tube according to claim 1, wherein the content of metal particles in the antistatic film is in a range of 0.01 to 5.0 wt. %.

3. A cathode-ray tube according to claim 1, wherein the metal oxide is silicon oxide.

* * * * *